US006214775B1

(12) United States Patent
Harrison

(10) Patent No.: US 6,214,775 B1
(45) Date of Patent: Apr. 10, 2001

(54) HAZE-FREE POST-TREATED SUCCINIMIDES

(75) Inventor: James J. Harrison, Novato, CA (US)

(73) Assignee: Chevron Chemical Company LLC, San Francisco, CA (US)

( * ) Notice: Subject to any disclaimer, the term of this patent is extended or adjusted under 35 U.S.C. 154(b) by 0 days.

(21) Appl. No.: 09/417,973

(22) Filed: Oct. 13, 1999

(51) Int. Cl.[7] ..... C10M 149/10; C10M 159/12
(52) U.S. Cl. ..... 508/222; 508/221; 508/287
(58) Field of Search ..... 508/221, 222

(56) References Cited

U.S. PATENT DOCUMENTS

| | | | | |
|---|---|---|---|---|
| 3,018,250 | | 1/1962 | Anderson et al. | 252/51.5 |
| 3,172,892 | | 3/1965 | Le Suer et al. | 260/268 |
| 3,361,673 | | 1/1968 | Stuart et al. | 252/51.5 |
| 3,381,022 | | 4/1968 | Le Suer et al. | 260/404.8 |
| 3,912,764 | | 10/1975 | Palmer | 260/346.8 |
| 4,234,435 | | 11/1980 | Meinhardt et al. | 252/51.5 |
| 4,612,132 | * | 9/1986 | Wollenberg et al. | 548/545 |
| 4,747,965 | | 5/1988 | Wollenberg et al. | 252/51.5 |
| 4,755,312 | * | 7/1988 | Wollenberg | 548/545 |
| 5,112,507 | | 5/1992 | Harrison | 252/51.5 A |
| 5,175,225 | | 12/1992 | Ruhe, Jr. | 526/272 |
| 5,235,067 | * | 8/1993 | Allen et al. | 548/520 |
| 5,286,799 | | 2/1994 | Harrison et al. | 525/285 |
| 5,319,030 | | 6/1994 | Harrison et al. | 525/285 |
| 5,334,321 | | 8/1994 | Harrison et al. | 252/51.5 |
| 5,356,552 | | 10/1994 | Harrison et al. | 252/51.5 |
| 5,565,528 | | 10/1996 | Harrison et al. | 525/327.6 |
| 5,616,668 | | 4/1997 | Harrison et al. | 526/271 |
| 5,716,912 | * | 2/1998 | Harrison et al. | 508/192 |
| 5,792,729 | | 8/1998 | Harrison et al. | 508/192 |
| 5,849,676 | * | 12/1998 | Harrison et al. | 508/291 |
| 5,872,083 | * | 2/1999 | Harrison et al. | 508/287 |
| 6,015,776 | | 1/2000 | Harrison et al. | 508/192 |

* cited by examiner

*Primary Examiner*—Ellen M. McAvoy
(74) *Attorney, Agent, or Firm*—Walter L. Stumpf; Richard J. Sheridan

(57) ABSTRACT

A haze-free post-treated succinimide prepared by treating an alkenyl or alkyl succinimide with an oil-soluble, strong acid and contacting the treated succinimide with a cyclic carbonate to form the haze-free post-treated succinimide. The time, temperature, and acid concentration of the treating step and the time and temperature of contacting step are adjusted, in combination, to form the post-treated succinimide haze-free.

31 Claims, No Drawings

HAZE-FREE POST-TREATED SUCCINIMIDES

The present invention relates to haze-free post-treated succinimides, their preparation, and their uses.

BACKGROUND OF THE INVENTION

Lubricating oil compositions for internal combustion engines generally contain a variety of additives to reduce or control deposits, wear, corrosion, etc. The present invention is concerned with compositions useful as dispersants in lubricating oil compositions.

In lubricating oils, dispersants function to control sludge, carbon, and varnish produced primarily by the incomplete combustion of the fuel, or impurities in the fuel, or impurities in the base oil used in the lubricating oil composition. Dispersants also control viscosity increase due to the presence of soot in diesel engine lubricating oils.

One of the most effective classes of lubricating oil dispersants is polyalkylene succinimides. In some cases, the succinimides have also been found to provide fluid-modifying properties, or a so-called viscosity index credit, in lubricating oil compositions. It produces a reduction in the amount of viscosity index improver that would otherwise have to be used.

Polyalkylene succinimides are generally prepared by the reaction of the corresponding polyalkylene succinic anhydride with a polyalkyl polyamine. Polyalkylene succinic anhydrides are generally prepared by a number of well-known processes. For example, there is a well-known thermal process (see, e.g., U.S. Pat. No. 3,361,673), an equally well-known chlorination process (see, e.g., U.S. Pat. No. 3,172,892), a combination of the thermal and chlorination processes (see, e.g., U.S. Pat. No. 3,912,764), and free radical processes (see, e.g., U.S. Pat. Nos. 5,286,799 and 5,319,030). Such compositions include one-to-one monomeric adducts (see, e.g., U.S. Pat. Nos. 3,219,666 and 3,381,022), as well as "multiply adducted" products, adducts having alkenyl-derived substituents adducted with at least 1.3 succinic groups per alkenyl-derived substituent (see, e.g., U.S. Pat. No. 4,234,435).

U.S. Pat. Nos. 3,361,673 and 3,018,250 describe the reaction of an alkenyl- or alkyl-substituted succinic anhydride with a polyamine to form alkenyl or alkyl succinimide lubricating oil dispersants and/or detergent additives.

U.S. Pat. No. 4,612,132 teaches that alkenyl or alkyl succinimides may be modified by reaction with a cyclic or linear carbonate or chloroformate such that one or more of the nitrogens of the polyamine moiety is substituted with a hydrocarbyl oxycarbonyl, a hydroxyhydrocarbyl oxycarbonyl, or a hydroxy poly(oxyalkylene) oxycarbonyl. These modified succinimides are described as exhibiting improved dispersancy and/or detergency in lubricating oils.

U.S. Pat. No. 4,747,965 discloses modified succinimides similar to those disclosed in U.S. Pat. No. 4,612,132, except that the modified succinimides are described as being derived from succinimides having an average of greater than 1.0 succinic groups per long chain alkenyl substituent.

U.S. Pat. No. 4,234,435 teaches a polyalkene-derived substituent group with a number average molecular weight ($M_n$) in the range of 1500 to 3200. For polybutenes, an especially preferred $M_n$ range is 1700 to 2400.

U.S. Pat. No. 5,112,507 discloses a polymeric ladder type polymeric succinimide dispersant in which each side of the ladder is a long chain alkyl or alkenyl, generally having at least about 30 carbon atoms, preferably at least about 50 carbon atoms. The dispersant is described as having improved hydrolytic stability and shear stress stability, produced by the reaction of certain maleic anhydride-olefin copolymers with certain polyamines. The patent further teaches that the polymer may be post-treated with a variety of post-treatments, and describes procedures for post-treating the polymer with cyclic carbonates, linear mono- or polycarbonates.

U.S. Pat. Nos. 5,334,321 and 5,356,552 disclose certain cyclic carbonate post-treated alkenyl or alkylsuccinimides having improved fluorocarbon elastomer compatibility, which are preferably prepared by the reaction of the corresponding substituted succinic anhydride with a polyamine having at least four nitrogen atoms per mole.

U.S. Pat. No. 5,716,912 discloses polyalkylene succinimides prepared by reacting, under reactive conditions, a mixture of a polybutene succinic acid derivative, an unsaturated acidic reagent copolymer of an unsaturated acidic reagent and an olefin, and a polyamine, then treating those succinimides with cyclic carbonates, linear mono- or polycarbonates or a boron compound.

SUMMARY OF THE INVENTION

The present invention provides a post-treated succinimide that is haze-free. One of the problems with post-treating succinimides with carbonates is that a haze is often formed. This haze problem is more pronounced when the succinimide is formed from reaction mixtures having an amine to total anhydride charge mole ratio (A/TA CMR) of greater than 0.5:1, yet such a higher A/TA CMR is desirable to get higher nitrogen levels and higher TBN.

This haze problem is also more pronounced when the cyclic carbonate to basic nitrogen charge mole ratio (EC/BN CMR) is greater than 1:1, yet such higher EC/BN CMR is desirable to get improved deposit control.

Our haze-free post-treated succinimide is prepared by a two-step process. In the first step, an alkenyl or alkyl succinimide is treated with an oil-soluble, strong acid. In the second step, the treated succinimide is contacted with a cyclic carbonate to post-treat the succinimide. The combination of time, temperature, and acid concentration of the first step and the time and temperature of the second step are adjusted to form the post-treated succinimide haze-free.

Preferably, the succinimide is a polybutene succinimide derived from polybutenes having a number average molecular weight of from 500 to 5000, more preferably from 2000 to 2400. In one embodiment, the succinimide is prepared by reacting under reactive conditions a mixture of a polybutene succinic acid derivative, an unsaturated acidic reagent copolymer of an unsaturated acidic reagent and an olefin, and a polyamine.

Preferably, the oil-soluble, strong acid is an oil-soluble, strong organic acid, more preferably a sulfonic acid. Preferably, the sulfonic acid is an alkyl aryl sulfonic acid. Most preferably, it is an alkyl benzene sulfonic acid wherein the alkyl group has from 4 to 30 carbon atoms. Preferably, the amount of sulfonic acid in the first step is from 0.1% to 10% based on the total weight of succinimide. When the cyclic carbonate to basic nitrogen charge mole ratio is higher than 1:1, or when the amine/total anhydride charge mole ratio is higher than 0.5:1, more sulfonic acid is needed to get satisfactory haze than when these charge mole ratios are lower. Usually a time from 1 to 20 hours and a temperature of from room temperature to 200° C. are sufficient for this step.

Preferably, the cyclic carbonate is either ethylene carbonate or propylene carbonate. Preferably, the carbonation step (b) is conducted at temperatures of from 0° C. to 250° C. Preferably, the molar charge of the cyclic carbonate to the basic nitrogen of the treated succinimide is from 0.2:1 to 10:1, more preferably from 0.5:1 to 5:1, still more preferably from 1:1 to 3:1, and most preferably approximately 2:1.

The haze-free post-treated succinimide can be used in a lubricating oil formulation comprising:

(a) a major amount of a base oil of lubricating viscosity, (b) from 1% to 20% of haze-free post-treated succinimide, (c) from 0% to 30% of at least one detergent, (d) from 0% to 5% of at least one zinc dithiophosphate, (e) from 0% to 10% of at least one oxidation inhibitor, (f) from 0% to 1% of at least one foam inhibitor, and (g) from 0% to 20% of at least one viscosity index improver.

For instance, the lubricating oil composition could be prepared blending together:

(a) a major amount of a base oil of lubricating viscosity, (b) from 1% to 20% of haze-free post-treated succinimide, (c) from 0% to 30% of at least one detergent, (d) from 0% to 5% of at least one zinc dithiophosphate, (e) from 0% to 10% of at least one oxidation inhibitor, (f) from 0% to 1% of at least one foam inhibitor, and (g) from 0% to 20% of at least one viscosity index improver.

The lubricating oil composition so produced by this method might have a slightly different composition than the initial mixture, because the components may interact.

The haze-free post-treated succinimide can be used in a concentrate comprising from 1% to 20% of a compatible organic liquid diluent and from 5% to 80% of succinimide. The remainder of the concentrate can be other additives.

DETAILED DESCRIPTION OF THE INVENTION

In its broadest aspect, the present invention involves haze-free post-treated succinimides, their preparation, and their uses.

Prior to discussing the invention in further detail, the following terms will be defined:

Definitions

As used herein the following terms have the following meanings unless expressly stated to the contrary:

The term "succinimide" is understood in the art to include many of the amide, imide, etc. species that are also formed by the reaction of a succinic anhydride with an amine. The predominant product, however, is succinimide and this term has been generally accepted as meaning the product of a reaction of an alkenyl- or alkyl-substituted succinic acid or anhydride with a polyamine, or the product of a reaction of a polybutene succinic acid derivative, an unsaturated acidic reagent copolymer of an unsaturated acidic reagent and an olefin, and a polyamine. Alkenyl or alkyl succinimides are disclosed in numerous references and are well known in the art. Certain fundamental types of succinimides and related materials encompassed by the term of art "succinimide" are taught in U.S. Pat. Nos. 2,992,708; 3,018,291; 3,024,237; 3,100,673; 3,219,666; 3,172,892; and 3,272,746, the disclosures of which are hereby incorporated by reference in their entirety for all purposes.

The term "polyalkylene succinic acid derivative" refers to a structure having the formula

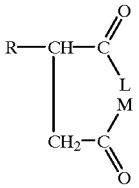

wherein R is a polyalkylene, and L and M are independently selected from the group consisting of —OH, —Cl, —O—, lower alkyl or taken together are —O— to form an alkenyl or alkylsuccinic anhydride group.

The term "unsaturated acidic reagent" refers to maleic or fumaric reactants of the general formula:

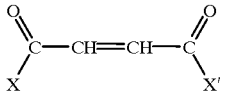

wherein X and X' are the same or different, provided that at least one of X and X' is a group that is capable of reacting to esterify alcohols, form amides, or amine salts with ammonia or amines, form metal salts with reactive metals or basically reacting metal compounds, and otherwise function as acylating agents. Typically, X and/or X' is —OH, —O-hydrocarbyl, —$OM^+$ where $M^+$ represents one equivalent of a metal, ammonium or amine cation, —$NH_2$, —Cl, —Br, and taken together X and X' can be —O— so as to form an anhydride. Preferably, X and X' are such that both carboxylic functions can enter into acylation reactions. Maleic anhydride is a preferred unsaturated acidic reactant. Other suitable unsaturated acidic reactants include electron-deficient olefins, such as monophenyl maleic anhydride; monomethyl, dimethyl, monochloro, monobromo, monofluoro, dichloro and difluoro maleic anhydride; N-phenyl maleimide and other substituted maleimides; isomaleimides; fumaric acid, maleic acid, alkyl hydrogen maleates and fumarates, dialkyl fumarates and maleates, fumaronilic acids and maleanic acids; and maleonitrile, and fumaronitrile.

The term "strong acid" refers to an acid having a $pK_a$ of less than about 4.

The term "oil-soluble, strong acid" refers to a strong acid that is soluble in oil.

The term "total anhydride" refers to the sum of moieties having an anhydride group (e.g. polybutene succinic acid derivatives and unsaturated acidic reagent copolymers of an unsaturated acidic reagent and an olefin).

The term "haze-free" refers to less than 20% haze. The measurement of % haze is carried out by first dissolving 4.0 grams of the sample in 25 ml of petroleum ether. Then the turbidity of the sample is measured using a suitable device for measuring haze. We used a device called COH300A ASTM Color and Saybolt Color Measuring Equipment, manufactured by Nippon Denshoku Industries Co. Ltd.

The term "Base Number" or "TBN" refers to the amount of base equivalent to milligrams of KOH in one gram of sample. Thus, higher TBN numbers reflect more alkaline products, and therefore a greater alkalinity reserve. The TBN of a sample can be determined by ASTM Test No. D2896.

The term "SAP" refers to Saponification Number and can be determined by the procedure described in ASTM D94.

The term "TAN" refers to Total Acid Number and can be determined by the procedure described in ASTM D 664.

Unless otherwise specified, all molecular weights are number average molecular weights ($M_n$).

Unless otherwise specified, all percentages are in weight percent and are based on the amount of active and inactive components, including any process oil or diluent oil used to form that component.

Haze-Free Post-Treated Succinimide

In the present invention, a haze-free post-treated succinimide is prepared by a two-step process. In the first step, an alkenyl or alkyl succinimide is treated with an oil-soluble, strong acid. In the second step, the treated succinimide is contacted with a cyclic carbonate to post-treat the succinimide. The combination of time, temperature, and acid concentration of the first step and the time and temperature of the second step are adjusted to form the post-treated succinimide haze-free.

Alkenyl or Alkyl Succinimide

The alkenyl or alkyl succinimide succinimides used in the present invention can be prepared by conventional processes, such as disclosed in U.S. Pat. Nos. 2,992,708; 3,018,250; 3,018,291; 3,024,237; 3,100,673; 3,172,892; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are all hereby incorporated by reference in their entirety for all purposes.

Preferably, the alkenyl or alkyl succinimide is a polybutene succinimide derived from polybutenes having a molecular weight of from 500 to 5000, more preferably from 2000 to 2400. Preferably, it is prepared by reacting, under reactive conditions, a mixture of a polybutene succinic acid derivative, an unsaturated acidic reagent copolymer of an unsaturated acidic reagent and an olefin, and a polyamine, such as taught in U.S. Pat. No. 5,716,912.

In one embodiment, the succinimide is formed from reaction mixtures having a charge mole ratio of amine to total anhydride of greater than 0.5:1.

The Oil-Soluble, Strong Acid

Preferably, the oil-soluble strong acid is an oil-soluble, strong organic acid. More preferably, the strong acid is a sulfonic acid. Still more preferably, the sulfonic acid is an alkyl aryl sulfonic acid. Most preferably, it is an alkyl benzene sulfonic acid wherein the alkyl group has from 4 to 30 carbon atoms.

Experimental work has shown that certain oil-insoluble, strong acids (e.g. sulfuric acid, toluene sulfonic acid, trifluoromethane sulfonic acid, and trifluoroacetic acid) do not work as well as oil soluble strong acids.

Preferably, the amount of sulfonic acid in the first step is from 0.1% to 10% based on the total weight of succinimide. When the ethylene carbonate to basic nitrogen charge mole ratio is higher, or when the amine/total anhydride charge mole ratio is higher, more sulfonic acid is needed to get satisfactory haze than when these mole ratios are lower.

While the Applicant does not wish to be bound by any particular theory of operation, it is believed that the oil-soluble, strong acid interacts in at least one of two ways. In one way, it reacts with residual amic acid (which is the initial reaction product during production of the succinimide) to form higher conversions of the succinimide. In another possible way, it reacts with the ammonium hydroxide byproduct (formed during the reaction of the succinimide with residual water of reaction) to produce a neutralized product. Then, when this is reacted with cyclic carbonate, less than 20% haze is produced (i.e., haze-free).

Cyclic Carbonates

The treated succinimide is contacted with a cyclic carbonate to form the haze-free post-treated succinimide. The reaction is conducted at a time and temperature sufficient to cause reaction of the cyclic carbonate with the treated succinimide. In particular, reaction temperatures of from 0° C. to 250° C. are preferred, with temperatures of from 100° C. to 200° C. being more preferred, and temperatures of from 150° C. to 180° C. being most preferred.

The reaction may be conducted neat—that is, both the alkenyl or alkyl succinimide and the cyclic carbonate are combined in the proper ratio, either alone or in the presence of a catalyst, such as an acidic, basic or Lewis acid catalyst, and then stirred at the reaction temperature. Examples of suitable catalysts include, for instance, phosphoric acid, boron trifluoride, alkyl or aryl sulfonic acid, alkali or alkaline carbonate.

Alternatively, the reaction may be conducted in a diluent. For example, the reactants may be combined in a solvent, such as toluene, xylene, oil or the like, and then stirred at the reaction temperature. After reaction completion, volatile components may be stripped off. When a diluent is employed, it is preferably inert to the reactants and to the products formed, and is generally used in an amount sufficient to insure efficient stirring.

Generally the mole ratios of the cyclic carbonate to the basic amine nitrogen of the treated succinimide are from 0.2:1 to 10:1, preferably from 0.5:1 to 5:1, more preferably from 1:1 to 3:1, most preferably about 2:1.

The reaction is generally complete from within 0.5 to 10 hours.

Useful cyclic carbonates are described in more detail in U.S. Pat. No. 4,612,132, which is incorporated herein by reference for their teaching of the preparation and use of cyclic carbonates.

Lubricating Oil Composition

The haze-free post-treated succinimides of the present invention are useful for imparting improved properties to an engine lubricating oil composition. Such a lubricating oil composition comprises a major part of base oil of lubricating viscosity and an effective amount of the polyalkylene succinimide composition of the present invention.

In one embodiment, an engine lubricating oil composition would contain (a) a major part of a base oil of lubricating viscosity;

(b) 1% to 20% of haze-free post-treated succinimide;

(c) 0% to 30% of at least one detergent;

(d) 0% to 5% of at least one zinc dithiophosphate;

(e) 0% to 10% of at least one oxidation inhibitor;

(f) 0% to 1% of at least one foam inhibitor; and (g) 0% to 20% of at least one viscosity index improver.

In a further embodiment, an engine lubricating oil composition is produced by blending a mixture of the above components. The lubricating oil composition produced by that method might have a slightly different composition than the initial mixture, because the components may interact. The components can be blended in any order and can be blended as combinations of components.

Base Oil of Lubricating Viscosity

The base oil of lubricating viscosity used in such compositions may be mineral oils or synthetic oils of viscosity suitable for use in the crankcase of an internal combustion engine. The base oils may be derived from synthetic or natural sources. Mineral oils for use as the base oil in this invention include paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

Other Additive Components

The following additive components are examples of some of the components that can be favorably employed in the present invention. These examples of additives are provided to illustrate the present invention, but they are not intended to limit it:

(1) Metal detergents: sulfurized or unsulfurized alkyl or alkenyl phenates, sulfurized or unsulfurized alkyl or alkenyl salicylates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

(2) Oxidation Inhibitors (a) Phenol type oxidation Inhibitors: 4,4'-methylene bis (2,6-di-tert-butylphenol), 4,4'-bis(2,6-di-tert-butylphenol), 4,4'-bis(2-methyl-6-tert-butylphenol), 2,2'-methylene bis (4-methyl-6-tert-butylphenol), 4,4'-butylene bis(3-methyl-6-tert-butylphenol), 4,4'-isopropylene bis(2,6-di-tert-butylphenol), 2,2'-methylene bis(4-methyl-6-nonylphenol), 2,2'-isobutylene bis(4,6-dimethylphenol), 2,2'-methylene bis (4-methyl-6-cyclohexylphenol), 2,6-di-tert-butyl-4-methylphenol, 2,6-di-tert-butyl4-ethylphenol, 2,4-dimethyl-6-tert-butylphenol, 2,6-di-tert-α-dimethylamino-p-cresol, 2,6-di-tert-4-(N, N' dimethylaminomethylphenol), 4,4'-thiobis(2-methyl-6-tert-butylphenol), 2,2'-thiobis(4-methyl-6-tert-butylphenol), and bis(3-methyl-4-hydroxy-5-tert-butylbenzyl)-sulfide.

(b) Diphenyl amine type oxidation inhibitor: alkylated diphenyl amine, phenyl-α-naphthylamine, and alkylated α-naphthylamine.

(c) Other types: metal dithiocarbamate (e.g., zinc dithiocarbamate), and methylenebis (dibutyldithiocarbamate).

(3) Rust Inhibitors (Anti-rust agents)

(a) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

(b) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

(4) Demulsifiers: addition product of alkylphenol and ethylene oxide, polyoxyethylene alkyl ether, and polyoxyethylene sorbitan ester.

(5) Extreme pressure agents (EP agents): zinc dialkyldithiophosphate (primary alkyl type & secondary alkyl type), sulfurized oils, diphenyl sulfide, methyl trichlorostearate, chlorinated naphthalene, fluoroalkylpolysiloxane, and lead naphthenate.

(6) Friction modifiers: fatty alcohol, fatty acid, amine, borated ester, and other esters.

(7) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenum complex compound.

(8) Viscosity Index improvers: polymethacrylate type polymers, ethylene-propylene copolymers, styrene-isoprene copolymers, hydrated styrene-isoprene copolymers, polyisobutylene, and dispersant type viscosity index improvers.

(9) Pour point depressants: polymethyl methacrylate.

(10) Foam Inhibitors: alkyl methacrylate polymers and dimethyl silicone polymers.

Additive Concentrates

Additive concentrates are also included within the scope of this invention. The concentrates of this invention comprise an organic diluent and the compounds or compound mixtures of the present invention, preferably with at least one of the additives disclosed above. The concentrates contain sufficient organic diluent to make them easy to handle during shipping and storage.

From 1% to 20% of the concentrate is organic diluent. From 5% to 80% of concentrate is haze-free post-treated succinimide. The remainder of the concentrate may comprise one or more of other additives discussed above. These percentages are based on the amount of active and inactive components, including any process oil or diluent oil used to form that component. The percent numbers for organic diluent would be greater if only the active components are considered.

Suitable organic diluents which can be used include for example, solvent refined 100N, i.e., Cit-Con 100N, and hydrotreated 100N, i.e., Chevron 100N, and the like. The organic diluent preferably has a viscosity of about from 1 to 20 cSt at 100° C.

The components of the additive concentrate can be blended in any order and can be blended as combinations of components.

Examples of Additive Packages

Below are representative examples of additive packages that can be used in a variety of applications. These representative examples employ the novel dispersants of the present invention. Unlike the percentages used in other sections of this specification, the following percentages are based on the amount of active component, with neither process oil nor diluent oil. (All process oils and diluent oils included are included in the figures for base oil of lubricating viscosity.) These examples are provided to illustrate the present invention, but they are not intended to limit it.

| | | |
|---|---|---|
| 1) | Haze-free post-treated succinimide | 35% |
| | Metal detergent | 25% |
| | Primary alkyl zinc dithiophosphate | 10% |
| | Base oil of lubricating viscosity | 30% |
| 2) | Haze-free post-treated succinimide | 40% |
| | Metal detergent | 20% |
| | Secondary alkyl zinc dithiophosphate | 5% |
| | Dithiocarbamate type oxidation inhibitor | 5% |
| | Base oil of lubricating viscosity | 30% |
| 3) | Haze-free post-treated succinimide | 35% |
| | Metal detergent | 20% |
| | Secondary alkyl zinc dithiophosphate | 5% |
| | Phenol type oxidation inhibitor | 5% |
| | Base oil of lubricating viscosity | 35% |
| 4) | Haze-free post-treated succinimide | 30% |
| | Metal detergent | 20% |
| | Secondary alkyl zinc dithiophosphate | 5% |
| | Dithiocarbamate type anti-wear agent | 5% |
| | Base oil of lubricating viscosity | 40% |
| 5) | Haze-free post-treated succinimide | 30% |
| | Metal detergent | 20% |
| | Secondary alkyl zinc dithiophosphate | 5% |
| | Molybdenum-containing anti-wear agent | 5% |
| | Base oil of lubricating viscosity | 40% |
| 6) | Haze-free post-treated succinimide | 30% |
| | Metal detergent | 20% |
| | Other additives | 10% |
| | Primary alkyl zinc dithiophosphate | |
| | Secondary alkyl zinc dithiophosphate | |
| | Alkylated diphenylamine-type oxidation inhibitor | |
| | Dithiocarbamate type anti-wear agent | |
| | Base oil of lubricating viscosity | 40% |

EXAMPLES

The invention will be further illustrated by following examples, which set forth particularly advantageous method embodiments. While the Examples are provided to illustrate the present invention, they are not intended to limit it.

Succinimide I

Synthesis of Succinimide with 0.7:1 A/TA CMR

To 76,299 grams of a mixture of diluent oil and PIBSA (SAP number 17.5 mg KOH/g sample, 11.9 moles) made from 2300 molecular weight polybutene, was added 2290 grams of heavy poly amine (HPA) (8.32 moles) at 85° C. with stirring. The amine/total anhydride charge mole ratio (A/TA CMR) was 0.7:1. This was heated to 160° C. and held there for two hours. Then vacuum was applied to the reactor to distill off any water, and then the temperature was cooled to room temperature. A product formed, 78,300 grams, which had 0.98% N, 21.6 TBN, and had a viscosity at 100° C. of 156 cSt. The haze was 2.9%, which was considered haze-free.

Comparative Examples A–C, and Examples 1–2

Ethylene Carbonate Post Treatment of Succinimide I with and without Sulfonic Acid In Comparative Example A, 9.70 grams (0.110 mole) ethylene carbonate was added to 100.48 grams of Succinimide I (dropwise) with stirring at 100° C. The succinimide and ethylene carbonate were then heated to 165° C. for five hours. The ethylene carbonate to basic nitrogen charge mole ratio (EC/BN CMR) was 2.0:1. The product from this reaction had a TBN of 14.0 and had a haze of 86.5%.

Using the procedure similar to Comparative Example A with Succinimide I, a number of different post treatment reactions were carried out, except that the succinimide had been treated with sulfonic acid prior to post treatment. The sulfonic acid used was an alkyl benzene sulfonic acid having $C_4$–$C_{30}$ alkyl groups. The procedure that we followed was to first add the sulfonic acid at room temperature to the solution of the succinimide. Then after stirring overnight at room temperature the reaction was heated to reaction temperature and the ethylene carbonate was added.

The results from this study are shown in Table 1. In each example, the PIBSA was made from 2300 molecular weight polybutene, the amine was a heavy polyamine, and the A/TA CMR was 0.7:1. Comparative Examples A and B differed from Examples 1 and 2 in that the level of sulfonic acid used was insufficient to make the post-treated succinimide haze free. In Comparative Example C, sulfuric acid was used instead of the sulfonic acid.

TABLE 1

REDUCTION OF HAZE USING SULFONIC ACID AT DIFFERENT LEVELS FOR A SUCCINIMIDE WITH AN A/TA CMR OF 0.7:1.

| Example | EC/BN CMR | Acid level, % | Haze % |
|---|---|---|---|
| Succinimide I | 0 | 0 | 2.9 |
| Comparative Example A | 2 | 0 | 86.5 |
| Comparative Example B | 2 | 0.5 | 67.3 |
| Example 1 | 2 | 1 | 3.8 |
| Example 2 | 2 | 2 | 0 |
| Comparative Example C* | 2 | 2 | 70 |

*Sulfuric Acid

This table shows the effect of added sulfonic acids on the haze level. For this succinimide, as little as 1% sulfonic acid reduced the haze to an acceptable level (less than 20% haze) for an amine/total anhydride charge mole ratio of 0.7:1 and an ethylene carbonate to basic nitrogen charge mole ratio of 2:1. Sulfuric acid didn't work as well as sulfonic acid.

Succinimide II

Synthesis of Succinimide with an A/TA CMR of 0.85:1

To 74,915 grams of a mixture of diluent oil and PIBSA (SAP number 17.5 mg KOH/g sample, 11.68 mole) made from 2300 molecular weight polybutene, was added 2731 grams HPA (9.93 mole) following the procedure of Succinimide I. The amine/total anhydride charge mole ratio was 0.85:1. The product produced, 77,400 grams, had 1.19% N, 26.5 TBN, and had a viscosity of 154 cSt at 100° C. The haze was 5.2%.

Comparative Examples D–F, and Examples 3–4

Ethylene Carbonate Post Treatment of Succinimide II with and without Sulfonic Acid Using the procedure of Comparative Example A with Succinimide II, a number of different post treatment reactions were carried out with different levels of sulfonic acid, at different ethylene carbonate to basic nitrogen charge mole ratios. The haze was measured for these products. Comparative Examples D through F differed from Examples 3 and 4 in that the level of sulfonic acid used was insufficient to make the post-treated succinimide haze free.

This data is summarized in Table 2. In each example, the PIBSA was made from 2300 molecular weight polybutene, the amine was a heavy polyamine, and the amine/total anhydride charge mole ratio was 0.85:1.

TABLE 2

REDUCTION OF HAZE USING SULFONIC ACID AT DIFFERENT LEVELS FOR A SUCCINIMIDE WITH AN A/TA CMR OF 0.85:1

| Example | EC/BN CMR | Acid level, % | Haze % |
|---|---|---|---|
| Succinimide II | 0 | 0 | 5.2 |
| Comparative Example D | 2 | 0 | 89.5 |
| Comparative Example E | 2 | 1 | 81.2 |
| Example 3 | 2 | 2 | 0.8 |
| Comparative Example F | 3 | 2 | 96.9 |
| Example 4 | 3 | 4 | 2.6 |

This table shows that when the ethylene carbonate to basic nitrogen charge mole ratio was higher, and/or when the amine/total anhydride charge mole ratio was higher, more sulfonic acid was needed to get satisfactory haze than when these charge mole ratios were lower.

Succinimide III

Synthesis of the Succinimide Reaction Product of PIBSA, a Copolymer, and an Amine with an A/TA CMR of 0.7:1

To 716.06 grams of a mixture of diluent oil and PIBSA (SAP number 17.5 mg KOH/g sample, 0.112 mole), made from 2300 molecular weight polybutene, was added 93.51 grams of a copolymer, made from $C_{14}$ alpha olefin and maleic anhydride dissolved in $C_9$ aromatic solvent (SAP number 134 mg KOH/g sample, 0.112 mole), followed by 43.06 grams HPA (0.157 mole). The PIBSA/copolymer ratio was 1.0:1 and the amine/total anhydride CMR was 0.7:1. This was reacted at 165° C. for 6 hours. Then the $C_9$ aromatic solvent was distilled in vacuo. This product had 1.74% N, a TBN of 40.1 mg KOH/g sample, a TAN of 1.34 mg KOH/g sample, and a viscosity @100° C. of 260 cSt. The haze for this material was 2.7%.

Comparative Examples G–H, and Example 5

Ethylene Carbonate Post Treatment of Succinimide III with and without Sulfonic Acid Using the procedure of Comparative Example A with Succinimide III, a number of different post treatment reactions were carried out with different levels of sulfonic acid. The haze was measured for these products.

Comparative Examples G and H differed from Example 5 in that the level of sulfonic acid used was insufficient to make the post-treated succinimide haze free.

This data is summarized in Table 3. In each example, the PIBSA was made from 2300 molecular weight polybutene, the copolymer was $C_{14}$ alpha olefin and maleic anhydride, the PIBSA to copolymer ratio was 1:1, the amine was a heavy polyamine, and the amine/total anhydride charge mole ratio was 0.7:1.

TABLE 3

POST TREATMENT OF THE SUCCINIMIDE REACTION PRODUCT OF PIBSA, A COPOLYMER, AND AN AMINE WITH ETHYLENE CARBONATE

| Example | EC/BN CMR | Sulfonic acid level | Haze |
|---|---|---|---|
| Succinimide III | 0 | 0 | 2.7 |
| Comparative Example G | 2 | 0 | 86.1 |

TABLE 3-continued

POST TREATMENT OF THE SUCCINIMIDE REACTION PRODUCT OF PIBSA, A COPOLYMER, AND AN AMINE WITH ETHYLENE CARBONATE

| Example | EC/BN CMR | Sulfonic acid level | Haze |
|---|---|---|---|
| Comparative Example H | 2 | 0.5 | 83.7 |
| Example 5 | 2 | 1.0 | 18.3 |

This table shows that the effect of adding sulfonic acids to reduce the haze level also applies to the succinimide reaction product of a PIBSA, a copolymer, and an amine.

Comparative Example I

Addition of Water to the Succinimide (A/TA CMR 0.85) before Sulfonic Acid Treatment To 502 grams of Succinimide II was added 1.25 milliliters water. This was stirred overnight at 60° C. This was done to simulate incomplete water removal during the succinimide stage of the reaction. To this was then added 2.0% sulfonic acid and the mixture was stirred for 20 minutes at 60° C. Then the temperature was raised to 160° C. and this product was post treated with ethylene carbonate 68.35 grams (0.78 mole) following the procedure of Example 3. The product from this reaction had a haze of 40.4%. For comparison when the same reaction was carried out without the addition of 1.25 mL of water, the haze was 0.2 This experiment shows that incomplete water removal during the succinimide stage leads to poorer haze in the post treated product.

This experiment shows that added water has a deleterious effect on haze in the post treated product.

Comparative Example J

Ethylene Carbonate Post Treatment of a Succinimide with a High Level of Amic Acid A succinimide was prepared according to the procedure of Succinimide III except that a mixture of 50% $C_{14}$, 30% $C_{16}$, and 20% $C_{18}$ alpha olefin was used instead of 100% $C_{14}$ alpha olefin, and a PIBSA/copolymer ratio of 2.33:1 was used instead of 1.0:1. This product had 1.53% N, a viscosity @100° C. of 209 cSt, and a TAN of 2.35 mg KOH/g sample. This product was post treated with ethylene carbonate using the procedure of Comparative Example G except that the succinimide was heated with 2% sulfonic acid at 60° C. for 20 minutes. The haze for this product was 84%. In this case treating the succinimide with 2% sulfonic acid at 60° C. for 20 minutes was insufficient to reduce the haze to a suitable level. This experiment shows that higher TAN, which is indicative of higher levels of amic acid in the succinimide, has a deleterious effect on haze in the post treated product.

Comparative Example K

Ethylene Carbonate Post Treatment of a Succinimide with a Low Level of Amic Acid The succinimide prepared in Comparative Example J, which had a TAN of 2.35 mg KOH/g sample, was heated at 160° C. overnight with a nitrogen sweep. The product from this reaction had a TAN of 1.67 mg KOH/g sample. This product was then heated with 2% sulfonic acid at 60° C. for 20 minutes followed by post treatment with ethylene carbonate as in Comparative Example G. The haze for this product was 30%. Although this haze was not at a satisfactory level, this shows that lower amic acid levels, as evidenced by lower TAN, has a beneficial effect on haze.

Comparative Example L through P and Example 6

Effect of Temperature and Time on Haze

The next experiments were carried out on the sample of succinimde with the TAN of 2.35 mg KOH/g sample, that had been prepared in Comparative Example J. The data in the table shows that the effect of heating time and temperature is important in reducing the haze. We reacted this succinimide with the sulfonic acid for the time and temperature indicated in the table followed by reaction with ethylene carbonate at 165° C. using an EC/BN CMR ratio of 2.0:1.

TABLE 4

| Example | Temp, ° C. | Sulfonic acid treatment time | Sulfonic acid level, % | Haze |
|---|---|---|---|---|
| Comparative L | 60 | 20 min. | 2 | 85 |
| Comparative M | 160 | 20 min. | 2 | 82.4 |
| Comparative N | 160 | 2 hr. | 2 | 81.1 |
| Example 6 | 160 | 16 hr. | 2 | 9.2 |
| Comparative O | 180 | 2 hr. | 2 | 29.4 |
| Comparative P | 180 | 2 hr. | 0 | 91 |

This data shows that if you treat the succinimide with the sulfonic acid for only 20 minutes at either 60 or 160° C., this was insufficient time and temperature for reducing the haze. For this sample a total of 16 hours at 160° C. treatment time with the sulfonic acid was required in order to get acceptable haze. It is expected that variations in different samples of succinimides will lead to slightly different times, temperatures, and sulfonic acid levels in order to get desirable haze for the post treated products.

While the present invention has been described with reference to specific embodiments, this application is intended to cover those various changes and substitutions that may be made by those skilled in the art without departing from the spirit and scope of the appended claims.

What is claimed is:

1. A haze-free post-treated succinimide prepared by the process comprising:

(a) treating an alkenyl or alkyl succinimide with an oil-soluble, strong acid, and (b) contacting said treated succinimide with a cyclic carbonate to form said post-treated succinimide, wherein the time, temperature, and acid concentration of step (a) and the time and temperature of step (b) are sufficient, in combination, to form said post-treated succinimide haze-free.

2. A haze-free post-treated succinimide according to claim 1 wherein said alkenyl or alkyl succinimide is a polybutene succinimide derived from polybutenes having a number average molecular weight of from 500 to 5000.

3. A haze-free post-treated succinimide according to claim 2 wherein said alkenyl or alkyl succinimide is a polybutene succinimide derived from polybutenes having a number average molecular weight of from 2000 to 2400.

4. A haze-free post-treated succinimide according to claim 1 wherein said alkenyl or alkyl succinimide is prepared by reacting a mixture under reactive conditions, wherein the mixture comprises:

(a) a polybutene succinic acid derivative, (b) an unsaturated acidic reagent copolymer of an unsaturated acidic reagent and an olefin, and (c) a polyamine.

5. A haze-free post-treated succinimide according to claim 1 wherein said succinimide is formed from reaction mixtures having a charge mole ratio of amine to total anhydride of greater than 0.5:1.

6. A haze-free post-treated succinimide according to claim 1 wherein said oil-soluble, strong acid is an oil-soluble, strong organic acid.

7. A haze-free post-treated succinimide according to claim 6 wherein said strong acid is a sulfonic acid.

8. A haze-free post-treated succinimide according to claim 7 wherein said sulfonic acid is an alkyl aryl sulfonic acid.

9. A haze-free post-treated succinimide according to claim 8 wherein said alkyl aryl sulfonic acid is an alkyl benzene sulfonic acid, and the alkyl group of said alkyl benzene sulfonic acid has from 4 to 30 carbon atoms.

10. A haze-free post-treated succinimide according to claim 7 wherein the sulfonic acid is present in an amount of from 0.1% to 10%, based on the total weight of succinimide.

11. A haze-free post-treated succinimide according to claim 1 wherein said cyclic carbonate is ethylene carbonate.

12. A haze-free post-treated succinimide according to claim 1 wherein said cyclic carbonate is propylene carbonate.

13. A haze-free post-treated succinimide according to claim 1 wherein step (b) is conducted at a temperature of from 0° C. to 250° C.

14. A haze-free post-treated succinimide according to claim 1 wherein the charge mole ratio of the cyclic carbonate to the basic nitrogen of the treated succinimide is from 0.2:1 to 10:1.

15. A haze-free post-treated succinimide according to claim 14 wherein the charge mole ratio of the cyclic carbonate to the basic nitrogen of the treated succinimide is from 0.5:1 to 5:1.

16. A haze-free post-treated succinimide according to claim 15 wherein the charge mole ratio of the cyclic carbonate to the basic nitrogen of the treated succinimide is from 1:1 to 3:1.

17. A haze-free post-treated succinimide according to claim 16 wherein the charge mole ratio of the cyclic carbonate to the basic nitrogen of the treated succinimide is approximately 2:1.

18. A lubricating oil formulation comprising:

(a) a major amount of a base oil of lubricating viscosity;

(b) from 1% to 20% of the haze-free post-treated succinimide according to claim 1;

(c) from 0% to 30% of at least one detergent;

(d) from 0% to 5% of at least one zinc dithiophosphate;

(e) from 0% to 10% of at least one oxidation inhibitor;

(f) from 0% to 1% of at least one foam inhibitor; and (g) from 0% to 20% of at least one viscosity index improver.

19. A method of producing a lubricating oil composition comprising blending the following components together:

(a) a major amount of a base oil of lubricating viscosity;

(b) from 1% to 20% of the haze-free post-treated succinimide according to claim 1;

(c) from 0% to 30% of at least one detergent;

(d) from 0% to 5% of at least one zinc dithiophosphate;

(e) from 0% to 10% of at least one oxidation inhibitor;

(f) from 0% to 1% of at least one foam inhibitor; and (g) from 0% to 20% of at least one viscosity index improver.

20. A lubricating oil composition produced by the method according to claim 19.

21. A concentrate comprising from 1% to 20% of a compatible organic liquid diluent and from 5% to 80% of the haze-free post-treated succinimide according to claim 1.

22. A process comprising:

(a) treating an alkenyl or alkyl succinimide with an oil-soluble, strong acid, and (b) contacting said treated succinimide with a cyclic carbonate to form a post-treated succinimide, wherein the time, temperature, and acid concentration of step (a) and the time and temperature of step (b) are sufficient, in combination, to form said post-treated succinimide haze-free.

23. A process according to claim 22 wherein said alkenyl or alkyl succinimide is a polybutene succinimide derived from polybutenes having a number average molecular weight of from 2000 to 2400.

24. A process according to claim 22 wherein said alkenyl or alkyl succinimide is prepared by reacting a mixture under reactive conditions, wherein the mixture comprises:

(a) a polybutene succinic acid derivative, (b) an unsaturated acidic reagent copolymer of an unsaturated acidic reagent and an olefin, and (c) a polyamine.

25. A process according to claim 22 wherein said succinimide is formed from reaction mixtures having a charge mole ratio of amine to total anhydride of greater than 0.5:1.

26. A process according to claim 22 wherein said oil-soluble, strong acid is an alkyl aryl sulfonic acid.

27. A process according to claim 26 wherein the alkyl group of said alkyl aryl sulfonic acid has from 4 to 30 carbon atoms, the aryl group is benzene, and the sulfonic acid is present in an amount of from 0.1% to 10%, based on the total weight of succinimide.

28. A process according to claim 22 wherein said cyclic carbonate is ethylene carbonate.

29. A process according to claim 22 wherein step (b) is conducted at a temperature of from 0° C. to 250° C.

30. A process according to claim 22 wherein the charge mole ratio of the cyclic carbonate to the basic nitrogen of the treated succinimide is from 0.2:1 to 10:1.

31. A process according to claim 30 wherein the charge mole ratio of the cyclic carbonate to the basic nitrogen of the treated succinimide is from 1:1 to 3:1.

* * * * *